United States Patent [19]

Nilsen

[11] 4,136,499

[45] Jan. 30, 1979

[54] METHOD FOR MAKING A REINFORCED WALL OR FOUNDATION

[76] Inventor: Walter Nilsen, Prins Oscarsgt. 32, Drammen, Norway

[21] Appl. No.: 836,460

[22] Filed: Sep. 26, 1977

[30] Foreign Application Priority Data

Sep. 27, 1976 [NO] Norway ..... 763301
Mar. 25, 1977 [NO] Norway ..... 771060

[51] Int. Cl.[2] ..... E02G 27/00
[52] U.S. Cl. ..... 52/741
[58] Field of Search ..... 52/309.9, 309.11, 309.12, 52/405, 294, 169.1, 169.11, 741, 742

[56] References Cited

U.S. PATENT DOCUMENTS

| | | | |
|---|---|---|---|
| 2,262,899 | 11/1941 | Mechlin | 52/405 |
| 3,106,227 | 10/1963 | Crowley | 52/309.12 |
| 3,298,433 | 1/1967 | Lemelson | 52/309.12 |
| 3,383,817 | 5/1968 | Gregori | 52/309.11 |
| 3,512,818 | 5/1970 | Morgan | 52/309.11 |
| 3,679,529 | 7/1972 | Prusinski | 52/309.12 |

*Primary Examiner*—John E. Murtagh
*Attorney, Agent, or Firm*—Nolte & Nolte

[57] ABSTRACT

A method of erecting a building which comprises installing internal, panel-like forms; mounting a metallic reinforcing mesh spaced from said walls and thereafter spraying a concrete or other settable mass onto said formwork and reinforcing mesh to incorporate the form and mesh into a wall with the concrete. In the building of a house, the formwork and reinforcement can be erected as, for example, a foundation or other lower level and thereafter the walls and floors of the upper levels may be disposed upon that form. Only subsequently need the spraying of the concrete onto the reinforcing mesh be completed.

4 Claims, 4 Drawing Figures

FIG. 3.
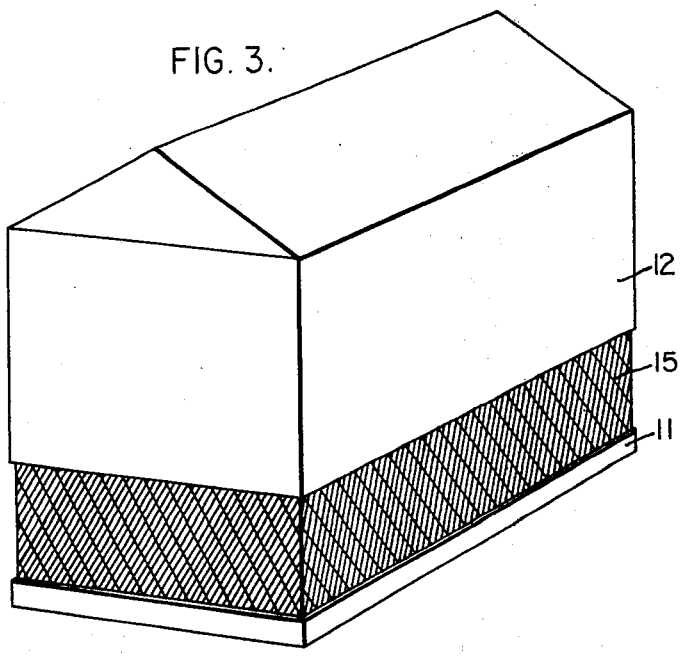
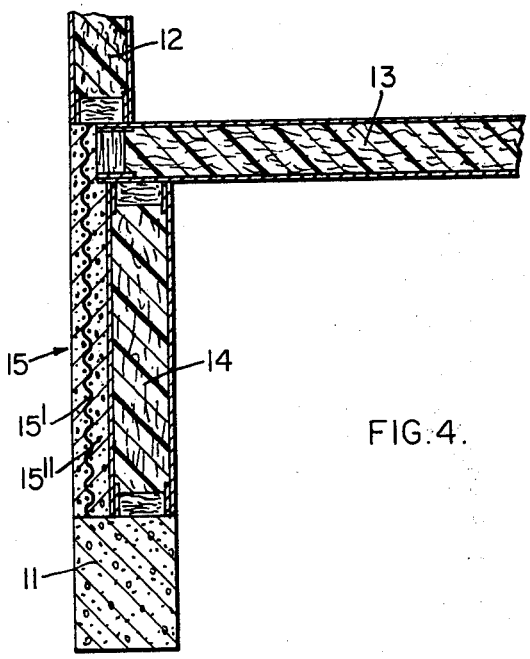
FIG. 4.

METHOD FOR MAKING A REINFORCED WALL OR FOUNDATION

It is previously known a large number of proposals for making reinforced walls or foundations by means of suitable formworks and concrete castings which are preferably reinforced. Similarly it has been proposed to use suitable block elements, possibly in combination with panels on one or both sides. From Norwegian patent application No. 75.3720 it is known a method where a formwork made from a plate material forming the inner panel of the foundation is erected and supported. At the outside of said formwork and adjacent thereto a wall of suitable blocks is erected, said blocks being positioned to form vertical columns having mutual spaces there between in order to form vertical free channels between said columns, in which columns thereafter a suitable reinforcing is introduced, and said channels are thereafter filled with concrete or its equivalent to form vertical supports. The blocks used may be of light weight concrete material or its equivalent, and the casting material is suitably concrete, and the inner formwork is made from unitary plates of porous plastic material having a panelling made from gypsum. Over the top of the array of columns reinforcing elements are positioned and which elements are embedded into a continuous horizontal concrete beam which is integral with the vertical columns. The blocks are erected on a basis of reinforced concrete, preferably integral with the concrete in said columns and said beam, and the reinforcings in said basis, said columns and said top beam are mutually connected.

Building of houses by means of self supporting plates is inter alia known from Norwegian Pat. No. 129 211. It may however with such houses be necessary to have a high foundation due to the environment or terrain around the house and/or a simultaneous wish to have a large cellar under the house. It has previously been common practice to cast such foundations by means of double faced formworks before the remaining portion of the house is build or put into position, alternatively to build the foundation from blocks of concrete or the like.

The present invention has as its object to simplify the building of such foundations in such a manner that it is independent of the remaining building work on the house. The invention has as a further object to provide a new and advantageous method for making a reinforced wall or foundation, whereby it is possible in a quick and simple manner to provide a structure having both the required insulating capacity and strength, so that the structure may support substantial stresses both in vertical and horizontal directions.

The characterizing features of the invention will appear from the attached claims and from the following description with reference to the drawings.

FIG. 3 shows in a second embodiment a completely erected house made from self supporting plates where the foundation is made ready for final casting.

FIG. 4 shows a section through a lower portion of the house in FIG. 3.

Figure 1:
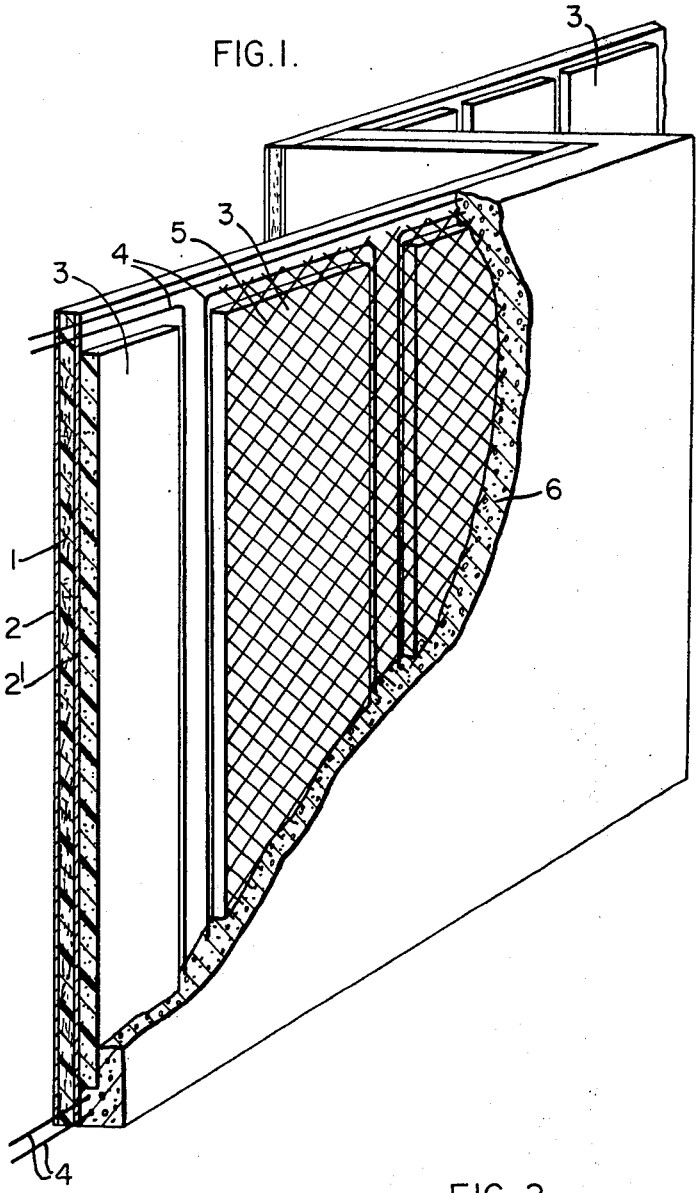
FIG. 1 shows in a first embodiment of the invention a portion of a reinforced wall or foundation depicted in perspective and having a section cut away in order to more clearly illustrate the composition of the structure.

In the process of making the structure of FIG. 1 plate elements are erected and supported, and said plate elements may be of the type having a core 1 of porous plastic material which on both sides is limited by gypsum or gypsum plates 2, 2'. Said plates are forming the inner panel of the structure. The plate elements are on their outer side, i.e. on the outside of the gypsum board 2' provided with plate shaped elements 3 e.g. made from rigid foamed plastic material, said plates 3 being fixed to the gypsum board 2' by adhesive or other means. The plates 3 preferably have a dimension in the height direction which is somewhat less than that of said plate element 1, 2, 2'. Said plates 3 are fixed at even intervals in the longitudenal direction of said plate element, as will appear from FIG. 1. Thus openings are formed between adjacent plates 3 and likewise there is formed horizontal spaces at both the upper and lower edge of said plates as will appear from FIG. 1. Said spaces and openings form guides for steel reinforcements 4, as will appear from FIG. 1.

Outside the exposed surface of the plate 3 a reinforcing network 5 is positioned, as will appear from FIG. 1. Said reinforcing network should preferably lie at a certain distance from said plates 3.

Figure 2:
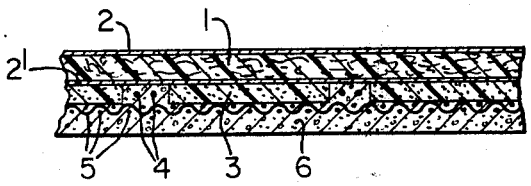
FIG. 2 shows a cross section through a portion of the structure in FIG. 1.

Concrete 6 is then sprayed onto the wall or the foundation and will enter said guides and enclose both said steel reinforcements 4 as well as said reinforcing network 5, as will appear from FIG. 2.

FIG. 3 illustrates a completed house made from self supporting plate elements where at the lower end there has been made a low base 11 of e.g. concrete blocks or the like or casted. From FIG. 4 it is seen that a vertical self supporting element is positioned upon the base 11, said element forming an inner formwork for the foundation and simultaneously having sufficient strenght to support the overlying stresses from the house and further providing a thermal insulation of the room inside the foundation. At the upper edge of the element 14 there is arranged a horizontally positioned self supporting element 13 and a vertically standing self supporting element 12, where the element 13 forms e.g. a floor in the house and the element 12 a wall in said house. The element 12 is as will appear from FIG. 4 staggered relative to the element 14, the portion not resting on the upper edge of said element 14 being intended to rest on the foundation 15 when casted, as will be described below. A reinforcement 15' made from iron network or netting or the like is arranged at a certain distance from the outer side of the element 14, whereafter concrete 15" is sprayed onto said reinforcement and said element 14 to provide a reinforced foundation 15 made from concrete. After the concrete has hardened the foundation will have full supporting capacity.

With the method according to the invention it is used a quick drying sprayable concrete which makes it simple for inter alia self constructors to make a reinforced wall or in particular a foundation which may sustain both high vertical and horizontal stresses e.g. from earth masses on the outside of said foundation.

It is of course possible to arrange, before spraying on the concrete, openings in said foundation to provide for windows, doors and ventilation ducts.

The said self supporting elements can be of e.g. the type consisting of two gypsum plates or the like between which a layer of insulating material, e.g. polyurethane foam has been provided.

As will appear from the description above the house consisting of the self supporting plates is mounted directly on the foundation base whereafter the casting of the foundation can be made simultaneously with or after that other craft man's work, e.g. electrical or painting work, on the house has been carried out. Thus the invention yields a substantial time saving and rationalization in house building, which naturally yields a lower over-all price on the house.

With the present invention there is thus no demand for any outer formwork. With the embodiment of FIGS. 1 and 2 there is also achieved a structure which is easy to make and where the consumption of concrete is reduced relative to normal foundations, since the guides for the steel reinforcements 4 form beams and columns respectively in and otherwise unitary structure.

It will be understood that the example shown in the drawings and described above of a reinforced wall or foundation according to the invention may be modified in many ways within the frame of the invention. Thus other plate elements than the said described gypsum plates having intermediate there between porous plastics may be used as inner formwork and panel. Thus the choice of material is free as regards the plates 3 in FIG. 1. Further it will be understood that the invention is not restricted to the making of reinforced walls and foundations, but may also be used for making reinforced ceilings and floors.

I claim:

1. A method of building a house or the like comprising forming a wall supporting foundation; assembling a plurality of panel elements on said foundation to form exterior walls of a first level of said house; disposing a reinforcing structure about said walls and spaced from exterior surfaces thereof; mounting a floor and walls for an upper level of said house upon upper edges of said panel elements and thereafter incorporating said reinforcing structure into walls with said panel elements by applying a settable mass thereto, said panel elements having a particular thickness and said walls for said upper level having a similar thickness, said walls of said upper level being disposed above and offset from said said panel elements, and wherein said mass is applied to said exterior walls of said first level to a thickness whereby the surface of said mass is contiguous with an outer surface of a wall of said upper level.

2. A method as claimed in claim 1 wherein said mass is applied by spraying.

3. A method as claimed in claim 2 wherein said mass is concrete.

4. A method as claimed in claim 1 wherein said panel-like structure comprises two spaced gypsum boards between which is disposed an insulating material.

* * * * *